United States Patent [19]

Sakata et al.

[11] 4,384,783

[45] May 24, 1983

[54] FIXING DEVICE FOR WET-TYPE ELECTROPHOTOGRAPHIC COPYING MACHINES

[75] Inventors: Minehiro Sakata, Hachioji; Youji Koganei, Fussa; Yousuke Igarashi, Tachikawa; Ikuo Ota, Fussa, all of Japan

[73] Assignee: Iwatsu Electric Co., Ltd., Tokyo, Japan

[21] Appl. No.: 265,844

[22] Filed: May 21, 1981

[30] Foreign Application Priority Data

Jul. 10, 1980 [JP] Japan ..... 55-94139
Sep. 24, 1980 [JP] Japan ..... 55-135622[U]

[51] Int. Cl.[3] ..... G03G 15/20

[52] U.S. Cl. ..... 355/3 FU; 219/216; 432/60

[58] Field of Search ..... 355/3 FU, 10; 219/216, 219/388, 469; 432/60; 430/99, 124, 136; 118/641, 642

[56] References Cited

U.S. PATENT DOCUMENTS 3,449,547 6/1969 Goodman et al. ..... 219/216
3,449,548 6/1969 Adamek et al. ..... 219/216
4,193,680 3/1980 Yoshikawa ..... 219/216 X
4,219,327 8/1980 Idstein ..... 355/3 FU
4,223,203 9/1980 Elter ..... 219/216

*Primary Examiner*—R. L. Moses
*Attorney, Agent, or Firm*—Oblon, Fisher, Spivak, McClelland & Maier

[57] ABSTRACT

A fixing device is provided for a wet type electrophotographic copying machine in which an electrostatic latent image formed on a photosensitive sheet at its face is developed by a liquid developer, and then the liquid developer attached to the photosensitive sheet is squeezed out by a squeezing device before the developed image is thermally fixed on the sheet. The fixing device includes a heater for heating the photosensitive sheet while the latter is being held at its back against the heater as the sheet moves thereon, the heater having a source of heat such as an infrared lamp or tungsten halogen lamp or nicrome wire rubber heater, and a roller made of air-permeable moisture-absorptive spongy material and located in confronting relation to the heater, the roller being pressable against the face of the photosensitive sheet. With such an arrangement, the developed image on the photosensitive sheet can be fixed reliably and thoroughly without fixing marks.

11 Claims, 8 Drawing Figures

FIXING DEVICE FOR WET-TYPE ELECTROPHOTOGRAPHIC COPYING MACHINES

BACKGROUND OF THE INVENTION

1. Field of the Invention

The present invention relates to a fixing device for wet-type electrophotographic copying machines or especially for wet-type electrophotomechanical machines.

2. Prior Art

Generally, wet-type electrophotographic copying machines and wet-type electrophotomechanical machines are constructed to carry out the steps of developing an electrostatic latent image on a photosensitive sheet of paper with a liquid developer in a liquid development device, squeezing out the liquid developer off the photosensitive sheet, and fixing the visualized image on the sheet in a fixing device. Fixing devices used for the wet-type electrophotographic copying machines or electrophotomechanical machines are of the air-dried type or thermal fusion type, the latter being composed of a heat source such as a lamp and a fan for blowing air heated by the lamp against the photosensitive sheet. While the sheet which is fed from the squeeze device is being transported on a feed belt or a transport device comprising a guide plate and feed rollers, hot air is applied against the photosensitive sheet to dry the same and at the same time to fix the image on the photosensitive sheet. Such thermal fusion type fixing devices are increasingly equipped in wet-type electrophotomechanical machines for producing printing masters to thereby improve printing endurance thereof, and developers are being developed which will be best fit for the thermal fusion type fixing devices. In such fixing devices, however, only one lamp is normally insufficient for fusing the developer, and two lamps, while generating enough heat to fuse the developer, tend to brown or burn the photosensitive sheet when it becomes jammed in the fixing device and is caused to stay exposed directly to the illuminating lamps. With the direct-exposure lamps, it would be difficult to control temperatures as with a thermostat since the thermostat would be likely to be energized to switch off the lamps during movement of the photosensitive sheet, resulting in unthorough fixing. Furthermore, radiant heat produced from the heat source is so intensive that the temperature in the machine will rise to the point where the machine as a marketable product can be deemed unsatisfactory.

Some of the wet-type electrophotomechanical machines are sold as ITEK 135, 136 by ITEC International Inc., such machines having fixing devices which use three lamps rated 1 KW.

The electrophotomechanical machines are used mostly by printers who make a multiplicity of prints for their business and hence require printed images of high quality.

SUMMARY OF THE INVENTION

It is an object of the present invention to provide a fixing device for wet-type electrophotographic copying machines which as an improved efficiency of fixing a developer to a photosensitive sheet of paper.

Another object of the present invention is to provide a fixing device for wet-type electrophotographic copying machines which will produce fixed images of stabilized quality at all times.

Still another object of the present invention is to provide a fixing device for wet-type electrophotographic copying machines which includes a roller so constructed as to prevent re-transfer of a developer therefrom to a photosensitive sheet while an image is being fixed on the sheet.

Still another object of the present invention is to provide a fixing device for wet-type electrophotographic copying machines which allows easy separation therefrom of a photosensitive sheet during fixation.

Still another object of the present invention is to provide a fixing device for wet-type electrophotographic copying machines which will prevent a photosensitive sheet from becoming browned or burned while an image is being fixed on the sheet.

Still another object of the present invention is to provide a fixing device for wet-type electrophotomechanical machines which will produce an image of high quality usable as a printing master.

According to one aspect of the present invention, the foregoing objects can be achieved by a fixing device for a wet-type electrophotographic copying machine in which an electrostatic latent image formed on a photosensitive sheet at its face is developed by a liquid developer, and then the liquid developer attached to the photosensitive sheet is squeezed out by a squeeze device before the developed image is thermally fixed, said fixing device comprising a heater for heating the photosensitive sheet while the latter is being held at its back against said heater as the sheet moves thereon, said heater having a source of heat, and a roller made of air-permeable moisture-absorptive spongy material and located in confronting relation to said heater, said roller being pressable against the face of the photosensitive sheet.

According to another aspect of the present invention, the foregoing objects can be achieved by a fixing device for a wet-type electrophotographic copying machine in which an electrostatic latent image formed on a photosensitive sheet at its face is developed by a liquid developer, and then the liquid developer attached to the photosensitive sheet is squeezed out by a squeeze device before the developed image is thermally fixed, said fixing device comprising a panel of metal extending along a path of movement of the photosensitive sheet for heating the sheet while the latter is being held at its back against said metal panel as the sheet moves thereon a source of heat located downwardly of said metal panel opposite to said path of the photosensitive sheet; a roller made of air-permeable moisture-absorptive material and located is confronting relation to said metal panel, said roller being pressable against the face of the photosensitive sheet a first pair of rollers for feeding the photosensitive sheet supplied from the squeeze device onto said metal panel a second pair of rollers for discharging the photosensitive sheet from said metal panel a chamber having an inlet port at which said first pair of rollers is disposed and an outlet port at which said second pair of rollers is disposed, said metal panel and said first-mentioned roller being housed in said chamber, said chamber having a portion constituted by a frame of the wet-type electrophotographic copying machine and having a vent hole opening outwardly of said frame and means in said chamber for blowing air against the face of the photosensitive sheet and discharging heated air from said chamber outwardly of said frame.

BRIEF DESCRIPTION OF THE DRAWINGS

Various other objects, features and attendant advantages of the present invention will be more fully appreciated as the same become better understood from the following detailed description when considered in connection with the accompanying drawings in which like reference characters designate like or corresponding parts throughout the several views and wherein.

DETAILED DESCRIPTION OF THE PREFERRED EMBODIMENTS

Figure 1:
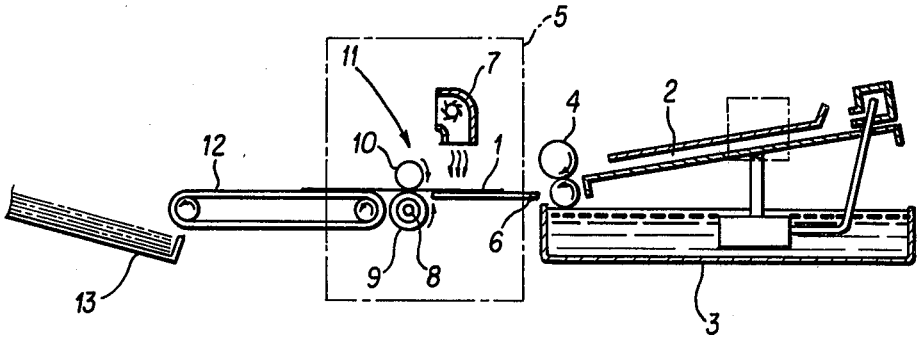
FIG. 1 is a schematic side elevational view, partly broken away, of a fixing device for a wet type electrophotographic copying machine according to one embodiment of the present invention.

As shown in FIG. 1, a photosensitive sheet 1 of paper on which an electrostatic latent image has been formed is developed in a development section 2 by a liquid developer supplied from a developer tank 3, and the liquid developer is squeezed out of the photosensitive sheet 1 by a squeezing device 4 before the sheet 1 is fed into a fixing device 5. The fixing device 5 comprises a fixing section 11 which includes a paper guide 6 for supporting thereon the photosensitive sheet 1 against at its back, an air blower or fan 7 disposed above the paper guide 6 for blowing air against the face of the sheet 1 supported on the paper guide 6 to dry the liquid developer off the sheet 1, a drive roller 9 in which a source 8 of heat such for example as an infrared lamp is disposed, and a pinch roller 10 for pressing the sheet 1 as it moves on against the drive roller 9. The photosensitive sheet 1 after the image has been fixed thereon is discharged by a feed belt 12 into a paper tray 13.

Figure 2:
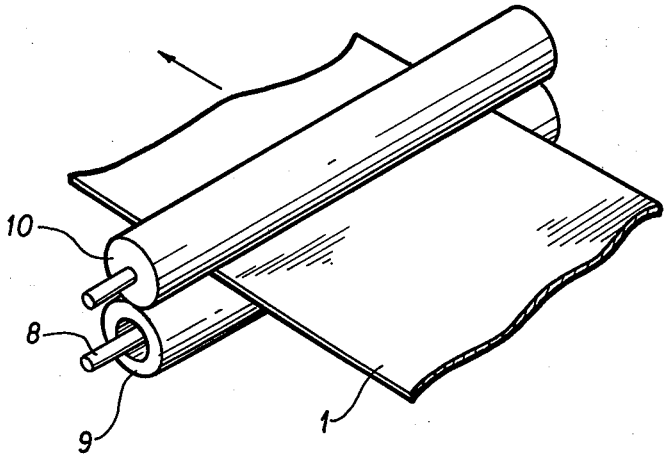
FIG. 2 is an enlarged perspective view of a fixing means as shown in FIG. 1.

In FIG. 2, the drive roller 9 is made as, for example, of silicone rubber or metal and is rotatively drivable by a drive source (not shown). The pinch roller 10 is made of air-permeable moisture-absorptive spongy material such as blotting paper and is held against the drive roller 9 as by gravity or a weak sprig (not shown) for being driven by the drive roller 9.

Although the developed sheet 1 is squeezed by the rollers 4 to remove the liquid developer and is dried by the air blower 7 before arriving at the fixing device 5, the sheet 1 remains still wet upon entering the fixing device 5. A small amount of the remaining liquid developer is therefore caused to be attached from the sheet 1 to the roller 10. However, the attached liquid developer is absorbed into the moisture-absorptive roller 10, and hence is free from the the danger of being transferred back to the sheet 1. Since the roller 10 is spongy, the sheet 1 can pass thereby without becoming stuck to the roller 10. Therefore, the roller 10 serves to press the sheet 1 into intimate contact with the roller 9 while allowing the sheet 1 to be easily separated therefrom, and also doubles as means for preventing the liquid developer from being transferred back to the sheet 1.

Figure 3:
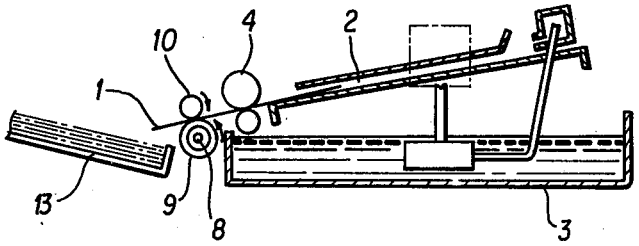
FIG. 3 is a schematic side elevational view, with parts broken away, of a fixing device for a wet type electrophotographic copying machine according to another embodiment.

As illustrated in FIG. 3, the guide 6, the air blower 7 and the feed belt 12 as shown in FIG. 1 may be dispensed with, and the fixing device may be composed only of the roller 9 having the heat source 8 and the roller 10 of air-permeable moisture-absorptive material, the rollers 9, 10 being located in the path of movement of the photosensitive sheet 1 from the squeezing rollers 4 down to the paper tray 13.

Figure 4:
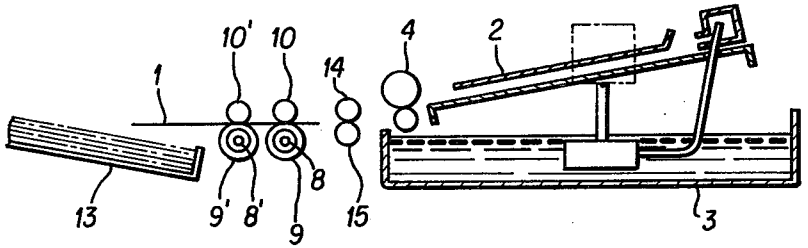
FIG. 4 is a schematic side elevational view, partly broken away, of a fixing device for a wet type electrophotographic copying machine according to still another embodiment.

According to another embodiment as illustrated in FIG. 4, another pair of drive and pinch rollers 9', 10' is added which is of the same construction as that of the rollers 9, 10, for increased fixing capability. The added drive roller 9' has a source 8' of heat as with the roller 9. If desired, a pair of feed rollers 14, 15 may be interposed between the squeeze rollers 4 and the rollers 9, 10, the feed roller 14 being preferably made of air-permeable moisture-absorptive material.

Figure 5:
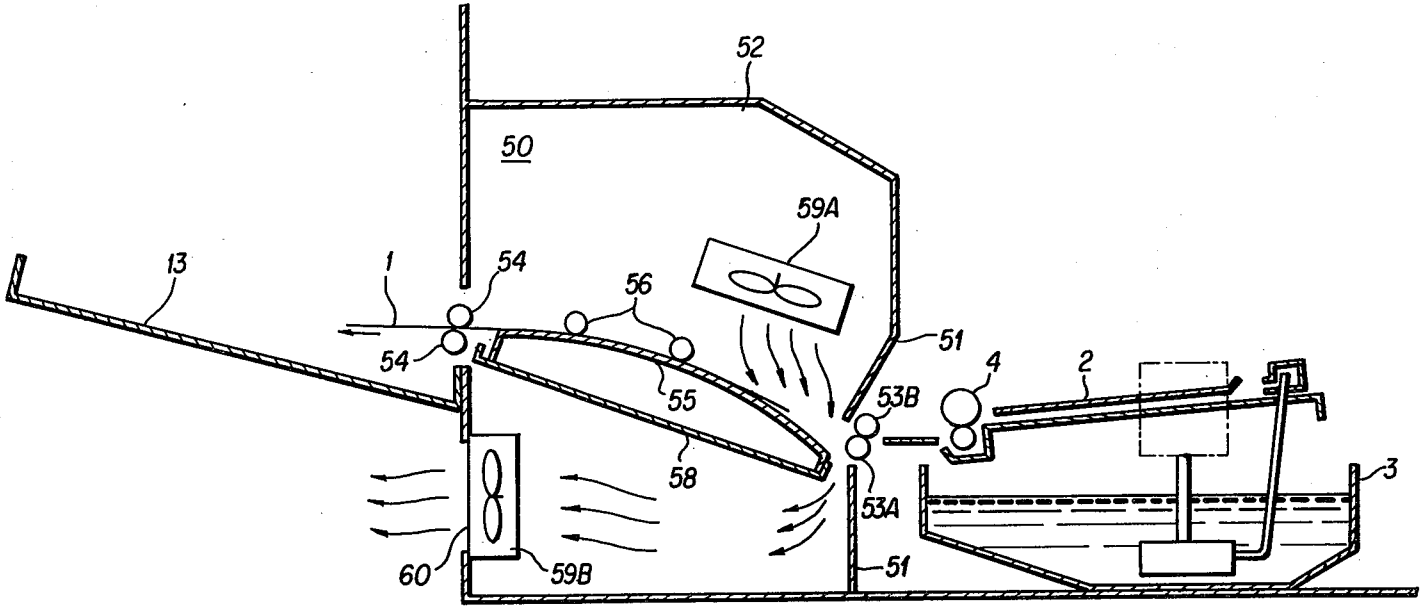
FIG. 5 is a schematic side elevational view, partly broken away, of a fixing device for a wet type electrophotographic copying machine in accordance with still another embodiment.
Figure 6:
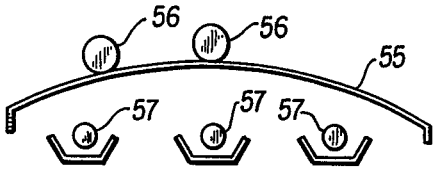
FIG. 6 is a side elevational view of a modified fixing means according to a modification.

FIG. 5 shows another fixing device 50 according to the present invention. A photosensitive sheet 1 of paper which is squeezed by squeeze rollers 4 is fed into the fixing device 50. The fixing device 50 is housed in a small-sized chamber 52 defined by a shield plate 51 that prevents heat radiation from getting into the copying machine. A pair of feed rollers 53A, 53B is disposed at an inlet port of the chamber 52 for feeding the sheet 1 into the fixing device 50. A pair of discharge rollers 54, 54 is disposed at an outlet port of the chamber 52 for discharging the sheet 1 into a paper tray 13. A panel 55 of metal is placed in the chamber 52 and defines along its upper surface a path of movement of the photosensitive sheet 1 between the pair of feed rollers 53A, 53B and the pair of discharge rollers 54, 54. The metal panel 55 is a panel heater and works for fixing an image on the sheet 1. One or more pinch rollers 56, 56 (two in the illustrated embodiment) of air-permeable moisture-absorptive material such as blotting paper are rotatably disposed on and held against the metal panel 55 as by gravity or weak springs (not shown) for pressing the sheet 1 intimately against the metal panel 55 while allowing easy separation from the rollers 56, 56 and preventing retransfer of the liquid developer to the sheet 1 as the latter progresses by. FIG. 6 shows a modification to heat the panel 55. Downwardly of the metal panel 5 and opposite the path of the sheet 1, there is disposed a source 57 of heat (FIG. 6) which comprises tungsten halogen lamps for heating the metal panel 55 up to a desired temperature which is 50° C. or higher, and preferably on the order of 120° C. for transferring the sheet 1 while being held in intimate contact with the metal panel 55. The source 57 of heat may be composed of a microme wire rubber heater provided in the back side of the metal panel 55. The temperature of the metal panel 55 is controlled by a thermostat (not shown) mounted on the panel 55. The sheet 1 is first driven forward by the feed rollers 53A, 53B, and then by the discharge rollers 54, 54, the arrangement being that the sheet 1 is gripped at its leading edge by the discharge rollers 54, 54 before the trailing edge of the sheet 1 leaves the feed rollers 53A, 53B. In the meantime, the image on the sheet 1 is fixed completely while the sheet 1 is on the metal panel 55. A panel guide 58 which is secured to a frame of the copying machine supports the metal panel 55 in position and serves to improve the thermal efficiency of the metal panel 55.

An air blower or fan 59A is disposed in the chamber 52 upwardly of the metal panel 55 for blowing air currents against the surface of the sheet 1 on which the image appears as the sheet 1 is introduced into the chamber 52 by the feed rollers 53A, 53B. Such air drying is necessary since the sheet 1 as it leaves the squeeze rollers 4 is still wet and by predrying the liquid developer off the sheet 1 the fixing efficiency on the metal panel 55 can be enhanced. A lower portion of the chamber 52 is constituted by the copying machine frame and has a vent hole opening outwardly of the machine frame and equipped with an air blower or fan 59B. Heated air produced by the fan 59A within the chamber 52 is forced to pass through a clearance between the metal panel 55 and the pair of feed rollers 53A, 53B and out of the chamber 52 through the hole 60 by the fan 59B. The feed rollers 53A, 53B are located as close to the shield plate 51 as possible to minimize the gap at the inlet port of the chamber 52 so that heated air can be prevented from leaking through the inlet port into the machine interior. Another vent hole may be provided in an upper portion of the shield plate 51 for allowing heated air to escape out of the chamber 52, thereby reducing a temperature rise in the copying machine.

Figure 7:
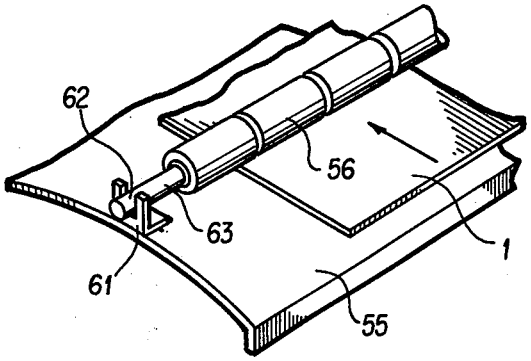
FIG. 7 is a fragmentary perspective view of a modified fixing means.
Figure 8:
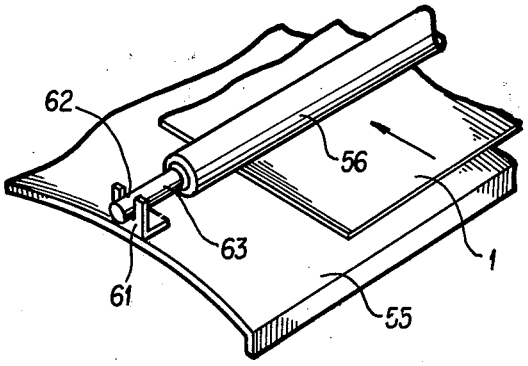
FIG. 8 is a fragmentary perspective view of another modified fixing means.

The roller 56 may comprise of a plurality of separate roller sections as shown in FIG. 7, or may comprise a single roller body as shown in FIG. 8. The roller 56 according to these modifications of FIGS. 7 and 8 has a shaft 63 rotatably received at each end thereof in a slot 62 in a support bracket 61 mounted on the metal panel 55. The roller 56 is pressed against the metal panel 55 by gravity.

Obviously, numerous modifications and variations of the present invention are possible in light of the above teachings. It is therefore to be understood that within the scope of the appended claims, the invention may be practiced otherwise than as specifically described herein.

What we claim is:

1. A fixing device for a wet type electrophotographic copying machine in which an electrostatic latent image formed on a photosensitive sheet at its face is developed by a liquid developer, and then the liquid developer attached to the photosensitive sheet is squeezed out by a squeezing device before the developed image is thermally fixed, said fixing device comprising:

heater means for heating the photosensitive sheet while a back portion of the sheet is held against said heater as the photosensitive sheet moves thereon wherein said heater means further comprises heat source means for heating said photosensitive sheet; and a roller made of air-permeable, moisture-absorptive spongy material and located in confronting relation to said heater means, said roller being pressable against the face of the photosensitive sheet.

2. A fixing device according to claim 1, wherein said heater means further comprises a panel of metal extending along a path of movement of the photosensitive sheet, said heater source means being located adjacent a lower portion of said metal panel opposite to said path of movement of the photosensitive sheet.

3. A fixing device according to claim 1, wherein said heater means further comprises a roller of silicone rubber and wherein said heat source means is positioned in said roller.

4. A fixing device according to claim 3, wherein said heat source means further comprises an infrared lamp.

5. A fixing device for a wet type electrophotographic copying machine in which an electrostatic latent image formed on a photosensitive sheet at its face is developed by a liquid developer, and then the liquid developer attached to the photosensitive sheet is squeezed out by a squeezing device before the developed image is thermally fixed, said fixing device comprising:

a panel of metal extending along a path of movement of the photosensitive sheet for heating the sheet while a back portion of the sheet is held against said metal panel as the photosensitive sheet moves thereon;

heat source means located adjacent a lower portion of said metal panel opposite to said path of movement of the photosensitive sheet;

a roller made of air-permeable, moisture absorptive material and located in confronting relation to said metal panel, said roller being pressable against the face of the photosensitive sheet;

a first pair of rollers for feeding the photosensitive sheet supplied from the squeeze device onto said metal panel;

a second pair of rollers for discharging the photosensitive sheet from said metal panel;

a chamber having an inlet port at which said first pair of rollers is disposed and an outlet port at which said second pair of rollers is disposed, said metal panel and said first-mentioned roller being housed in said chamber, said chamber having a portion constituted by a frame of the copying machine and having a vent hole opening outwardly of said frame; and means located in said chamber for blowing air against the face of the photosensitive sheet and discharging heated air from said chamber outwardly of said frame.

6. A fixing device according to claim 2 or 5, wherein said heat source means further comprises a tungsten halogen lamp.

7. A fixing device according to claim 1 or 5, wherein said roller further comprises a blotting paper roller.

8. A fixing device according to claim 5, wherein said means further comprises a first fan for blowing air against the photosensitive sheet fed by said first pair of rollers and a second fan located adjacent to said vent hole for discharging heated air out of said frame.

9. A fixing device according to claim 5, further comprising means for controlling said metal panel so as to be maintained at a temperature of 50° C. or higher.

10. A fixing device according to claim 9, wherein said temperature is approximately 120° C.

11. A fixing device according to claim 2 or 5, wherein said heat source means further comprises a microwave wire rubber heater.

* * * * *